United States Patent [19]

Young

[11] Patent Number: 4,592,271

[45] Date of Patent: Jun. 3, 1986

[54] LOUVERED VENT

[76] Inventor: Lester L. Young, 961 Mitchell Canyon Rd., Clayton, Calif. 94517

[21] Appl. No.: 766,241

[22] Filed: Aug. 16, 1985

[51] Int. Cl.[4] ..... F24F 13/00

[52] U.S. Cl. ..... 98/114; 98/121.1

[58] Field of Search ..... 98/110, 114, 121.1; 15/238; 52/473

[56] References Cited

U.S. PATENT DOCUMENTS

| | | | |
|---|---|---|---|
| 2,309,717 | 2/1943 | Siebenlist | 98/121.1 |
| 2,529,462 | 11/1950 | Touchett | 98/121.1 |
| 2,555,626 | 6/1951 | Avers et al. | 98/121.1 |
| 2,679,796 | 6/1954 | Froelich et al. | 98/114 |
| 2,956,496 | 10/1960 | Simblest | 98/121.1 |
| 3,320,868 | 5/1967 | Apouchtine | 98/114 |
| 3,336,715 | 8/1967 | Savary | 98/114 |
| 3,422,744 | 1/1969 | Tarnoff | 98/121.1 |
| 4,175,480 | 11/1979 | Beam, Jr. et al. | 98/114 |
| 4,274,330 | 6/1981 | Witten et al. | 98/114 |
| 4,452,024 | 6/1984 | Sterriker et al. | 98/121.1 |

*Primary Examiner*—Ronald C. Capossela

*Attorney, Agent, or Firm*—Paul L. Hickman

[57] ABSTRACT

A vent assembly characterized by a rear member having a perforated rear surface, and a front member having a front surface formed into a number of louvers. The side portions and bottom portions of the rear member are bent into L-shaped flanges which engage the inner dimensions of the front member. The front member has a top portion and side portions which are bent into L-shaped flanges to provide flashing for the assembly. The front member and rear member are permanently attached together to form a single unit, and a number of units can be vertically stacked to provide vent structures of various heights.

6 Claims, 6 Drawing Figures

LOUVERED VENT

BACKGROUND OF THE INVENTION

1. Field of the Invention

This invention relates generally to vents for buildings, and more particularly to exterior foundation vents.

2. Description of the Prior Art

Vents are often provided in buildings to insure a minimum amount of air flow through the building. This minimal air flow reduces mildewing and allows for the escape of hot air within the building.

Vents of the prior art are characterized by a screen member which is attached over an opening provided in an exterior wall of a building, and a protective frame member attached over the screen. Usually, the screen is applied to the frame at the factory.

A problem with vents of the prior art is that they are time consuming to install. First, the screen-and-frame combination must be applied over the opening. Flashing is then applied to the frame to prevent water from leaking into the structure.

Another problem encountered in the prior art is that the vents are designed for a particular size opening, requiring the manufacturing and stocking of a great number of vent sizes.

SUMMARY OF THE INVENTION

An object of this invention is to provide an exterior vent which can be quickly installed.

Another object of this invention is to provide an exterior vent which can be used in conjunction with one or more similar vents to cover exterior vent holes of various sizes.

Yet another object of this invention is to provide a vent assembly which is self-flashing.

Briefly, the invention comprises a rectangular rear member having top and bottom portions formed into L-shaped flanges, and a rectangular front member having top and side portions formed into similar, L-shaped flanges. The side and top portions of the front member engage the side and bottom portions of the rear member such that the vent is formed into a unitary structure.

A surface of the rear member is perforated to permit free air flow. A front surface of the front member is provided with a series of louvered openings each including a rectangular section separated from the front surface on three sides.

An advantage of this invention is that it is of unitary construction, and is thus more quickly installed than vents of the prior art.

Another advantage of this invention is that the various flanged portions of the front and rear members provide flashing for the vent assembly.

Yet another advantage of this invention is that the vent assemblies are vertically stackable such that the same assembly can be used to cover various size vent holes.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
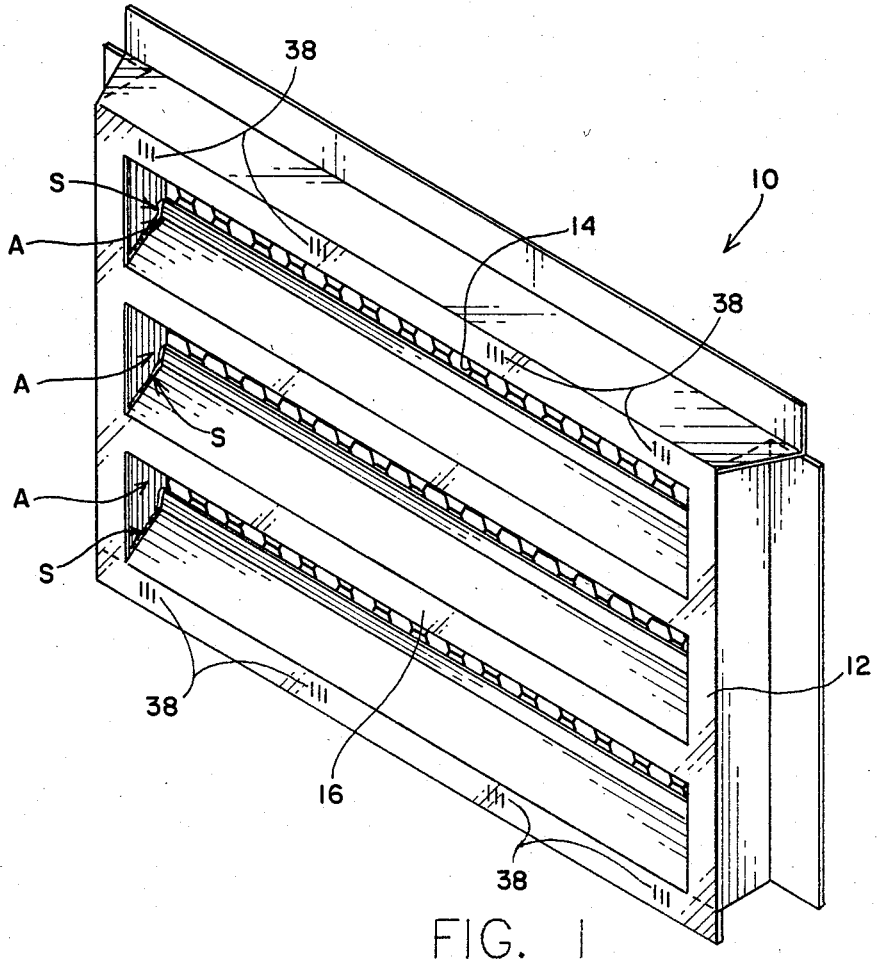
FIG. 1 is a perspective view of a vent assembly in accordance with the present invention.
Figure 2:
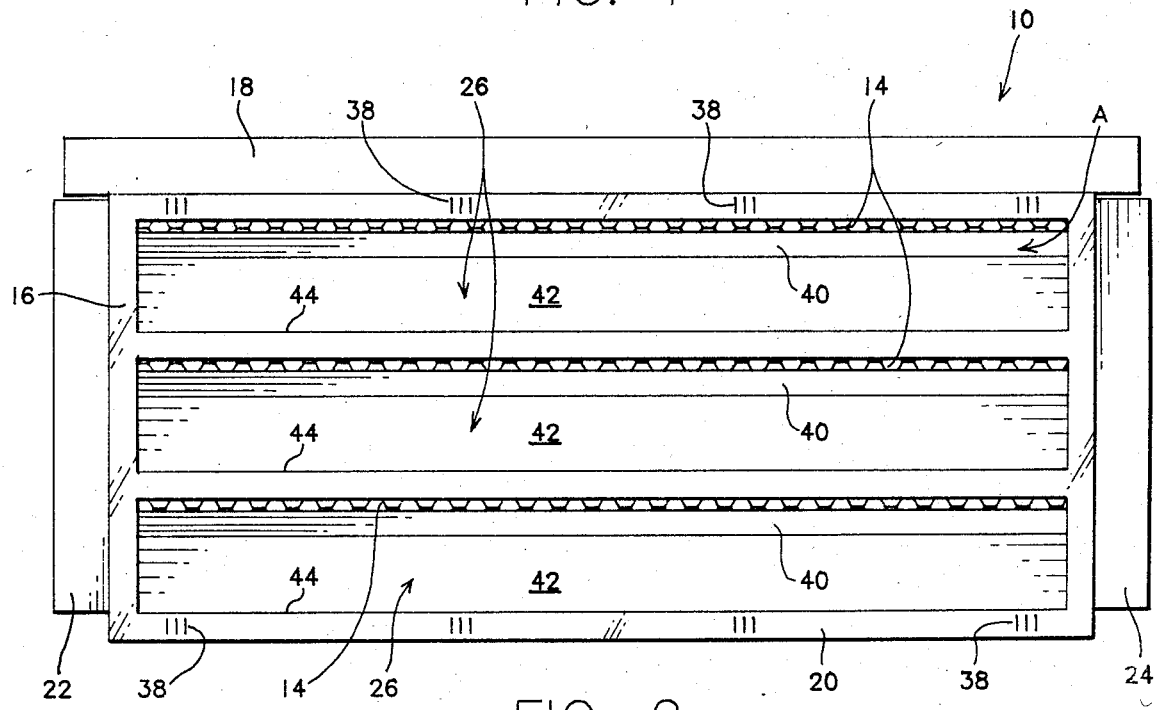
FIG. 2 is a front elevation of the vent assembly shown in FIG. 1.
Figure 3:
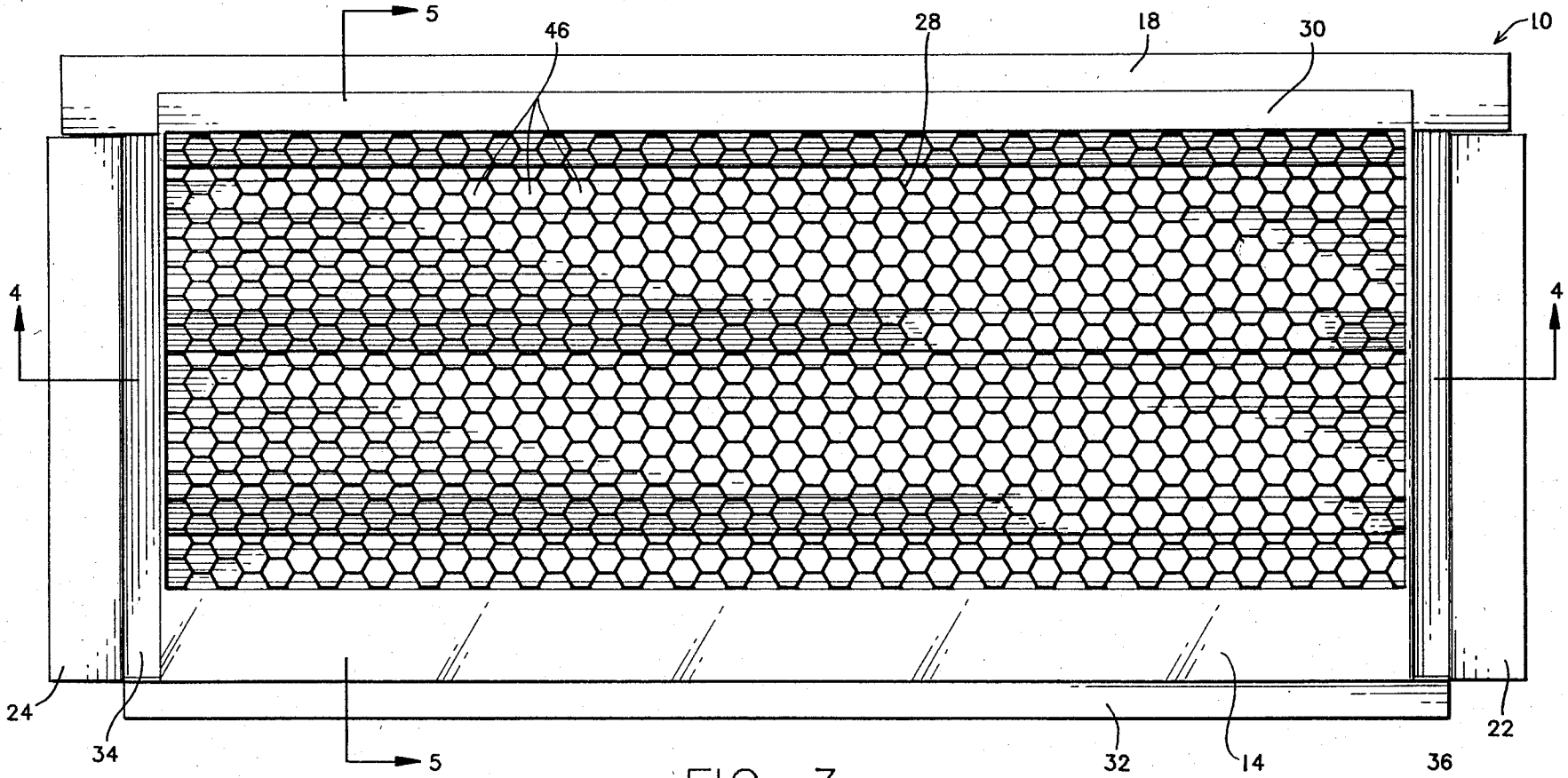
FIG. 3 is a rear elevation of the vent assembly.

Referring to FIGS. 1, 2, and 3, a unitary, louvered, self-flashing vent assembly 10 in accordance with the present invention includes a front member 12 and a rear member 14. Front member 12 is substantially rectangular and includes a front surface 16, a top front portion 18, a bottom front portion 20, a left side front portion 22, and a right side front portion 24. As will be discussing in greater details subsequently, portions of front surface 16 are formed into louvered sections 26. Rear member 14 is substantially rectangular and includes a rear surface 28, a top rear portion 30, a bottom rear portion 32, a right side rear portion 34, and a left side rear portion 36.

Figure 4:
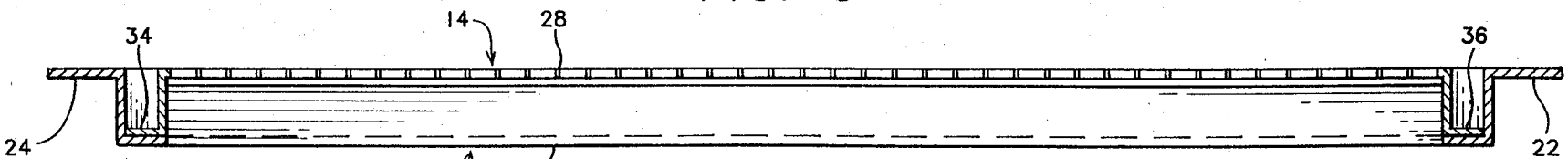
FIG. 4 is a cross section taken along line 4—4 of FIG. 3.

As best seen in FIG. 4, left side front portion 22 and right side front portion 24 are formed into L-shaped flanges which extend rearwardly and outwardly from front surface 16. Right side rear portion 34 and left side rear portion 36 are formed into L-shaped flanges which extend forwardly and outwardly from rear surface 28. The width of rear member 14 including portions 34 and 36 is designed to be equal to the interior width of front member 12 such that the rear member 14 nestles within front member 12.

Figure 5:
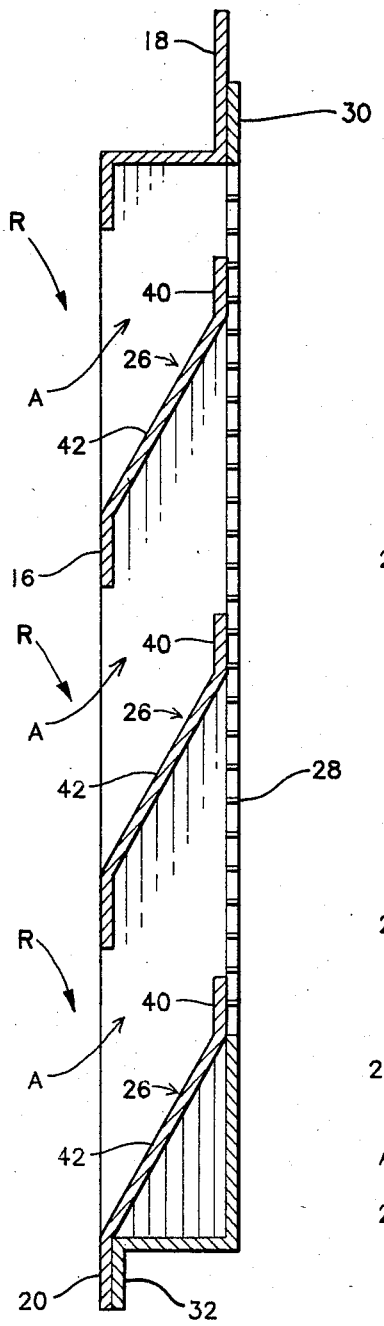
FIG. 5 is a cross section taken along line 5—5 of FIG. 3.

Referring to FIG. 5, top front portion 18 is formed into an L-shaped flange which extends rearwardly and outwardly from front surface 16. Bottom rear portion 32 is formed into an L-shaped flange which extends forwardly and outwardly from rear surface 28. Top front portion 18 engages the substantially flat top rear portion 30, and bottom rear portion 32 engages the substantially flat bottom front portion 20.

Referring generally to FIGS. 1, 2, and 3 the front member 12 is permanently affixed to the rear member 14 by means of a staking or stitching process at points 38 along front surface 16. Additionally, bent portions 40 of louvered sections 26 are affixed to the perforated rear surface 28. A sealant S is applied to the edges of lowered sections 26. Of course, the front member 12 and rear member 14 can be attached together by other means such as spot welding, riveting, and other well known fastening means and methods.

Referring primarily to FIGS. 2 and 4, louvered sections 26 include the bent portions 40, and angled portions 42. The substantially rectangular louver portions are stamped from front surface 16 such that they are attached to the front surface 16 only along a lower edge 44. The louvered sections 26 allow air flow through apertures A formed by the stamping process but prevent rain water, as indicated by the arrows R of FIG. 5, from penetrating rear surface 28 and entering the building.

Rear surface 28 is provided with a plurality of apertures 46 which are designed to maximize air flow through surface 28 while still providing strength to the rear surface. It has been found that a hexagonal aperture shape maximizes this design consideration, which creates the honeycomb appearance of the rear surface 28. However, other aperture shapes, such as circles, squares, etc. could also be utilized.

It should be noted that the L-shaped flanges of portions 18, 22, 24, and 32 provide flashing for the vent assembly 10. To install the vent assembly, the flashing is nailed or otherwise affixed to the wall of the structure over a vent hole, and then a wall surface or other sealing means is applied over the flashing.

Figure 6:
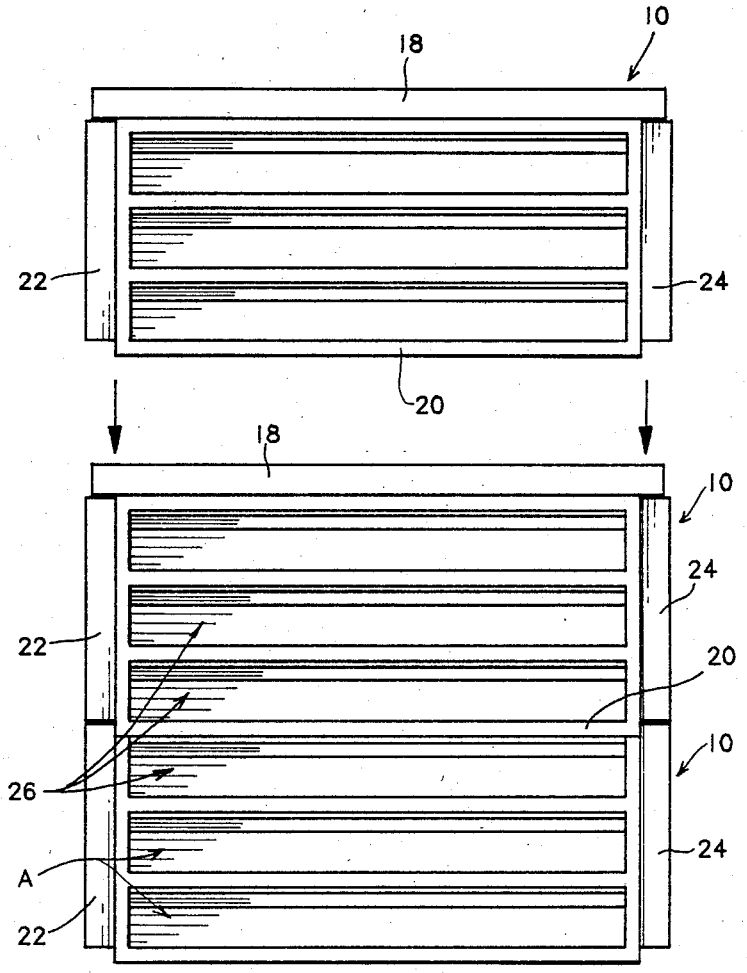
FIG. 6 is a front elevation illustrating the stackability of the vent assemblies of the present invention.

Referring to FIG. 6, a plurality of vent assemblies 10 can be vertically stacked to cover larger vent holes. The bottom front portion 20 of an upper vent assembly 10 is engaged with a top front portion 18 of the vent assembly 10 directly below it. The dimensions of the bottom front portion 20 and the top front portions 18 are designed such that the apertures A of the entire structure are uniformly spaced. From a distance, the structure created by the assemblage of several vent assemblies 10 has the appearance of single vent unit.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A unitary, louvered, self-flashing vent assembly comprising:

a rear member having a substantially rectangular, planar rear surface, and having opposing top rear and bottom rear portions and opposing side rear portions, wherein said side rear portions and said bottom rear portion are each bent to form an L shaped flange which extends forwardly from said planar rear surface, and wherein said planar rear surface is provided with a plurality of apertures to permit air flow through said rear surface;

a front member having a substantially rectangular, planar front surface having opposing top front and bottom front portions and opposing side front portions, wherein said side front portions and said top front portion are each bent to form an L shaped flange which extends rearwardly from said planar front surface to engage said side rear portions and said bottom rear portion, wherein said front surface is provided with a plurality of louvers extending between said side front portions; and means for attaching said front member to said rear member.

2. A unitary, louvered, self-flashing vent assembly as recited in claim 1 wherein said plurality of louvers are each substantially rectangular in shape and are attached to said front surface along a lower edge, said plurality of louvers extending towards said rear surface.

3. A unitary, louvered, self-flashing vent assembly as recited in claim 2 wherein each of said plurality of louvers include a flattened upper edge section.

4. A unitary, louvered, self-flashing vent structure including at least two louvered, self-flashing vent units, wherein each of said louvered, self-flashing vent units includes:

a rear member having a substantially rectangular, planar rear surface, and having opposing top rear and bottom rear portions and opposing side rear portions, wherein said side rear portions and said bottom rear portion are each bent to form an L shaped flange which extends forwardly from said planar rear surface, and wherein said planar rear surface is provided with a plurality of apertures to permit air flow through said rear surface;

a front member having a substantially rectangular, planar front surface having opposing top front and bottom front portions and opposing side front portions, wherein said side front portions and said top front portion are each bent to form an L shaped flange which extends rearwardly from said planar front surface to engage said side rear portions and said bottom rear portion, wherein said front surface is provided with a plurality of louvers extending between said side front portions; and means for attaching said front member to said rear member;

whereby said bottom rear portion and bottom front portion of a first louvered, self-flashing vent unit overlaps said top rear portion and said top front portion of a second louvered, self-flashing vent unit to form a contiguous louvered, self-flashing vent structure.

5. A unitary, louvered, self-flashing vent structure as recited in claim 4 wherein said plurality of louvers are each substantially rectangular in shape and are attached to said front surface along a lower edge, said plurality of louvers extending towards said rear surface.

6. A unitary, louvered, self-flashing vent structure as recited in claim 5 wherein each of said plurality of louvers include a flattened upper edge section that is attached to said rear surface.

* * * * *